US005485967A

United States Patent [19]

Ray et al.

[11] Patent Number: 5,485,967

[45] Date of Patent: Jan. 23, 1996

[54] YARN WINDING APPARATUS WITH MANIFOLD ASSEMBLY MOVABLE BETWEEN BLOWING AND STANDBY POSITIONS RELATIVE TO A PAIR OF BOBBIN CARRYING SPINDLES

[75] Inventors: Billy E. Ray, Liberty; Gregg T. Cox, Central; Fred D. Bryant, Six Mile; Jimmie A. Ray, Pickens; B. Joe Christopher, Easley; Dan C. Holcombe, Norris, all of S.C.

[73] Assignee: BASF Corporation, Mt. Olive, N.J.

[21] Appl. No.: 191,570

[22] Filed: Feb. 3, 1994

[51] Int. Cl.[6] ..... B65H 54/00

[52] U.S. Cl. ..... 242/18 A; 242/25 A

[58] Field of Search ..... 242/18 A, 25 A, 242/18 G, 35.5 T, 532.2

[56] References Cited

U.S. PATENT DOCUMENTS

| | | | |
|---|---|---|---|
| 3,664,596 | 5/1972 | Lenk . | |
| 3,857,522 | 12/1974 | Fink . | |
| 3,861,607 | 1/1975 | Schippers et al. . | |
| 4,186,890 | 2/1980 | Miller . | |
| 4,204,648 | 5/1980 | Minezaki et al. | 242/18 A |
| 4,216,920 | 8/1980 | Tambara et al. . | |
| 4,230,285 | 10/1980 | Lenk et al. . | |
| 4,339,089 | 7/1982 | Dobbins | 242/18 A |
| 4,444,362 | 4/1984 | Karr | 242/532.2 |
| 4,460,133 | 7/1984 | Turk et al. . | |
| 4,856,722 | 8/1989 | Horsey et al. | 242/18 A |
| 4,948,058 | 8/1990 | Behrens et al. | 242/18 A |
| 5,156,347 | 10/1992 | Gay, II et al. | 242/18 A |
| 5,318,237 | 6/1994 | Lotto et al. | 242/532.2 |
| 5,377,930 | 1/1995 | Noyes | 242/532.2 |

OTHER PUBLICATIONS

Research Disclosure, Jan. 1981, Anonymous Disclosure, No. 20140, "Control of Loose Yarn Ends at Package Doff".

*Primary Examiner*—Daniel P. Stodola
*Assistant Examiner*—Michael R. Mansen
*Attorney, Agent, or Firm*—Nixon & Vanderhye

[57] ABSTRACT

A manifold, which has a manifold assembly with a multiplicity of jets, which is connected to a drive for moving the manifold assembly in a stand-by position and in a blowing position, and a yarn winding apparatus for winding yarn packages, which has a frame, a turret disc, rotatably mounted on the frame, a multiplicity of spindles, rotatably mounted on the turret disc for holding bobbins, a transfer mechanism, connected to the frame, a winder head with a drive roll for rotating the spindles, connected to the frame, and the manifold, fixedly mounted on the frame. The manifold provides an air curtain within the yarn winding apparatus in order to reduce entanglement of the loose end of a fully wound yarn package with a new winding yarn package or other parts of the yarn winding apparatus.

11 Claims, 7 Drawing Sheets

YARN WINDING APPARATUS WITH MANIFOLD ASSEMBLY MOVABLE BETWEEN BLOWING AND STANDBY POSITIONS RELATIVE TO A PAIR OF BOBBIN CARRYING SPINDLES

FIELD OF THE INVENTION

The present invention relates to a movable manifold and a yarn winding apparatus containing the movable manifold for providing an air curtain between a fully wound yarn package and a new winding yarn package thereby reducing the entanglement of the loose end of the yarn of the fully wound yarn package with the new winding yarn package as well as with other parts of the winding apparatus.

BACKGROUND OF THE INVENTION

The winding of yarns is performed on yarn winding machines, which are described for example in U.S. Pat. Nos. 3,861,607 or 4,216,920. The winding machines have at least two spindles for holding bobbins, the spindles being rotatably mounted on a turret disc. The yarn is wound on one bobbin to form a yarn package. Once the package is full, doffing occurs, which means that the turret disc rotates and the yarn is led to the second bobbin and simultaneously cut and wound on the second bobbin.

At this point, it may occur that the loose end of the yarn of the rotating package of the first bobbin entangles in other parts of the yarn winding machine like the rotating second bobbin, leaving pieces of yarn in the second bobbin and in the winding machine, where it may contribute to off-quality yarn packages.

These packages may create problems for the end use during the manufacture of, for example, textiles or carpets, because of breakages of the yarns during unwinding from the packages.

There are proposals to reduce the yarn entanglement by, for example, special axially slidable thread gripping means as described in U.S. Pat. No. 4,460,133.

U.S. Pat. No. 4,230,285 discloses a traversing device for a thread winding apparatus which has a traverse slot, from where an air stream is directed outwardly to prevent the thread being wound or broken filaments thereof from entering the housing of the traversing device and being wrapped around the cam roller or interfering with the traversing thread guide in the housing.

Research Disclosure, January 1981, anonymous Disclosure No. 20140, "Control of Loose Yarn Ends at Package Doff," describes a yarn winding machine with a jet which is located close to the drive roll in order to provide a sheet of air along the length of the drive roll. The velocity of the jet is selected to exceed the velocity of the current of air rotating with the drive roll. One disadvantage of this fixedly mounted jet is that the produced sheet of air does not cover both ends of the two yarn packages equally well.

An object of the present invention is, to provide a device for a yarn winding apparatus which reduces the entanglement of loose yarn ends of a fully wound yarn package with a new winding yarn package and with other parts of the winding apparatus and reduces the amount of waste yarn ends in the winding apparatus.

SUMMARY OF THE INVENTION

The objects of the present invention were achieved with a manifold, which comprises:

(i) a manifold assembly comprising a multiplicity of jets; and (ii) means for moving the manifold assembly in a stand-by position and in a blowing position;

the manifold assembly being movably connected to the means for moving the manifold assembly;

and a yarn winding apparatus, which comprises:

(a) a frame;

(b) a turret disc, rotatably mounted on the frame;

(c) a multiplicity of spindles, rotatably mounted on the turret disc for holding bobbins;

(d) a transfer mechanism, fixedly connected to the frame;

(e) means for rotating the spindles, connected to the frame;

(f) a manifold, fixedly mounted on the frame, which comprises:

(i) a manifold assembly comprising a multiplicity of jets; and (ii) means for moving the manifold assembly in a stand by position and in a blowing position;

the manifold assembly being movably connected to the means for moving the manifold assembly.

DETAILED DESCRIPTION OF THE INVENTION

The manifold and the yarn winding apparatus of the present invention is described with reference to FIGS. 1 to 10.

Figure 1A:
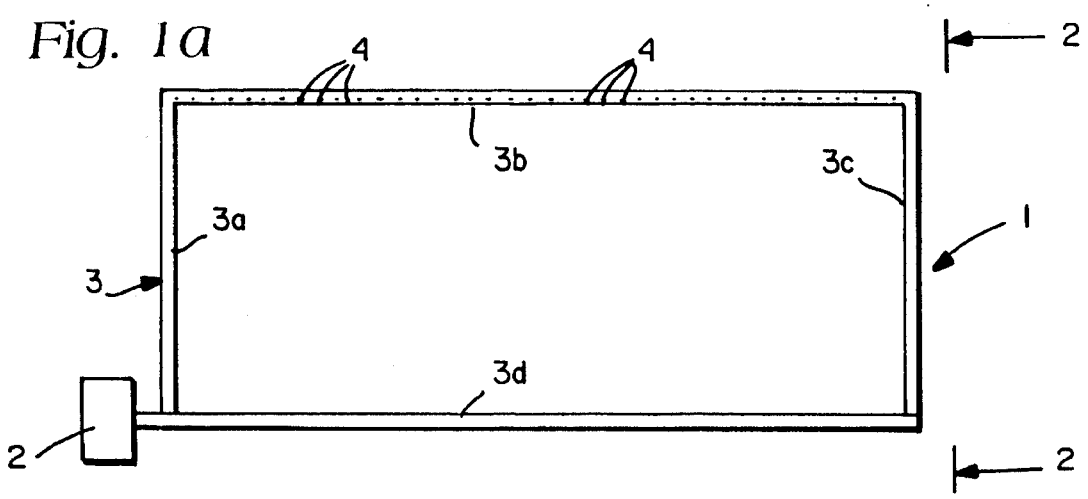
FIG. 1*a* is a frontal view of a manifold.

FIG. 1*a* is a frontal view of a manifold (1) with means for moving the manifold assembly (3) in a stand-by and in a operative or blowing position. The means for moving the manifold assembly (3) include all kinds of drives like an air pressure system, a hydraulic system, an electrical or internal combustion motor including transmissions like gears or chains and the like. The preferred drives are air pressure systems and hydraulic systems for moving the manifold assembly (3). The manifold assembly (3) includes hollow tubes (3*a*–3*d*), which are fluid-connected to each other. One of the tubes (3*b*) contains a multiplicity of jets (4) and is mounted in radially spaced relationship to the base tube (3*d*), by the longitudinally separated pair of riser tubes (3*a*, 3*c*). The tubes can be connected to an air source like an air compressor and may conduct the air from the air source to the jets (4).

Figure 1B:
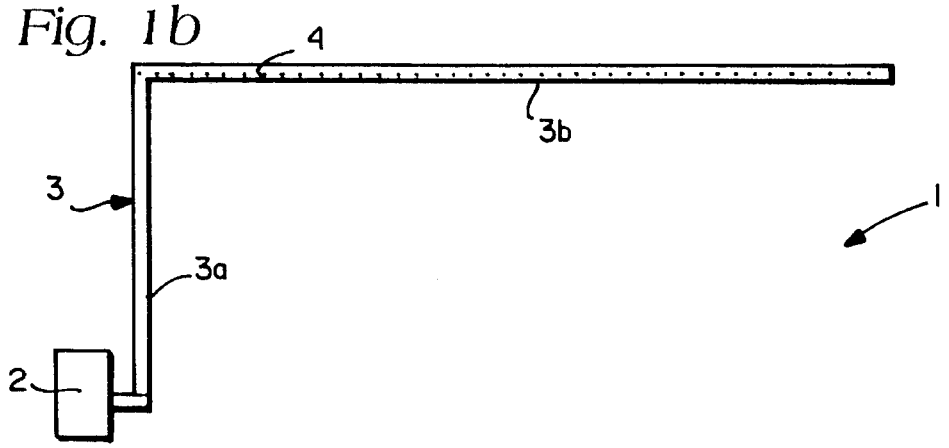
FIG. 1*b* is a frontal view of an alternative manifold, shown in FIG. 1*a*.

FIG. 1*b* shows an alternative to the manifold (1) shown in FIG. 1*a*, which has a manifold assembly (3) with two tubes (3*a*, 3*b*) which are connected to each other.

Figure 1C:
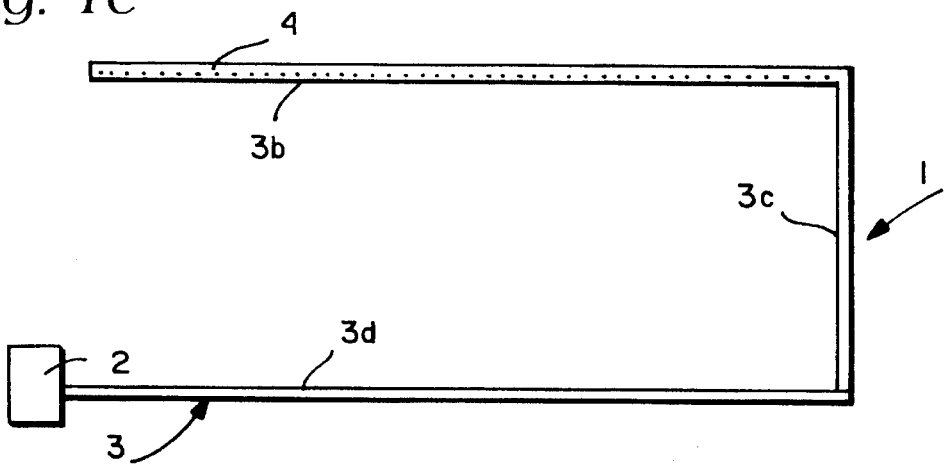
FIG. 1*c* is a frontal view of another alternative manifold, shown in FIG. 1*a*.

FIG. 1*c* shows another alternative to the manifold (1) shown in FIG. 1*a* which has a manifold assembly (3) with three tubes (3*b*–3*d*) which are connected to each other.

Figure 2:
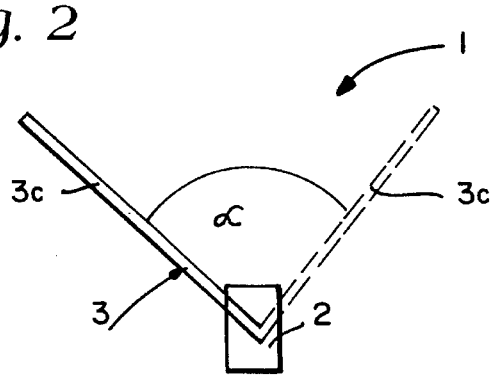
FIG. 2 is a side view of the manifold of FIG. 1*a* along the section 2—2 shown in FIG. 1*a*.

FIG. 2 shows a side view of the manifold (1) shown in FIG. 1*a*. The manifold assembly (3) is shown in the stand-by position and in dotted lines in the blowing position with the angle α between both positions.

FIGS. 3 to 9 show an example for a manifold (1), whereby the means for moving the manifold assembly (2) is a drive based on an air pressure system.

Figure 3:
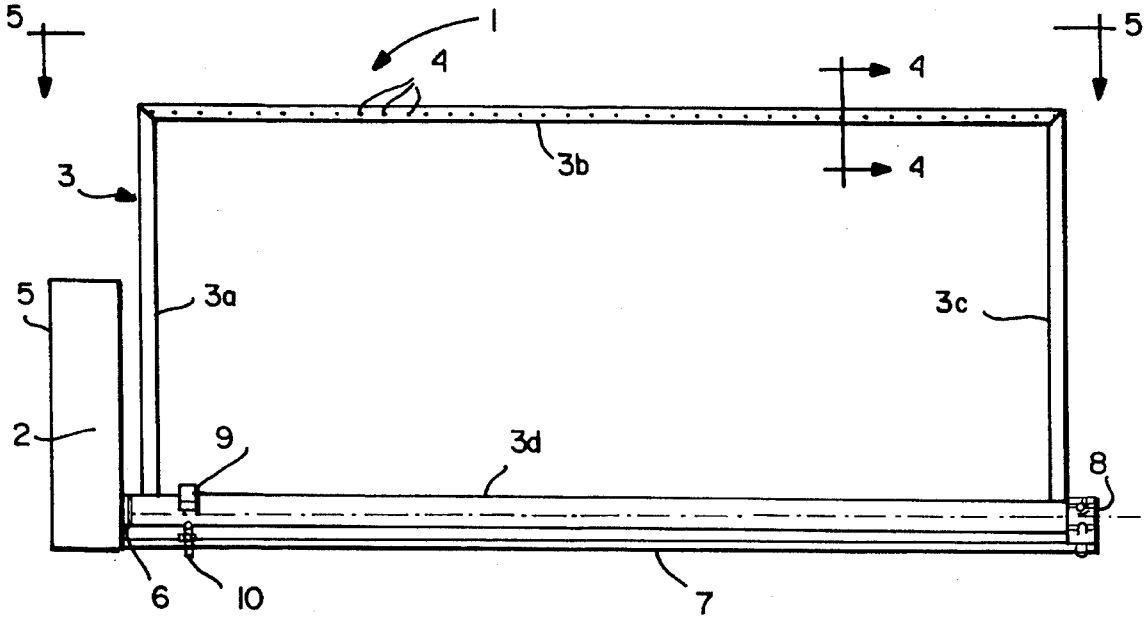
FIG. 3 is a frontal view of the manifold.

FIG. 3 shows the manifold (1) with the manifold assembly (3) having jets (4) for blowing air and the drive (2) with a drive housing (5). The manifold assembly (3) is pivotably connected to the drive (2) by the bushing (6). A first mounting angle bracket (7) is connected with one end to the drive housing (5) and with the other end to an end block (8) of the manifold assembly (3). A stop block (9) is mounted on the manifold assembly (3) which is stopped during rotation of the manifold assembly from the stand-by position into the blowing position by a screw (10) which is mounted on the first mounting angle (7).

Figure 4:
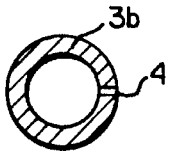
FIG. 4 is a cross-sectional view of the manifold assembly including a jet along the section 4—4, shown in FIG. 3.

FIG. 4 is a cross-sectional view of the manifold assembly (3) including one of the jets (4) along the section 4—4, shown in FIG. 3.

Figure 5:
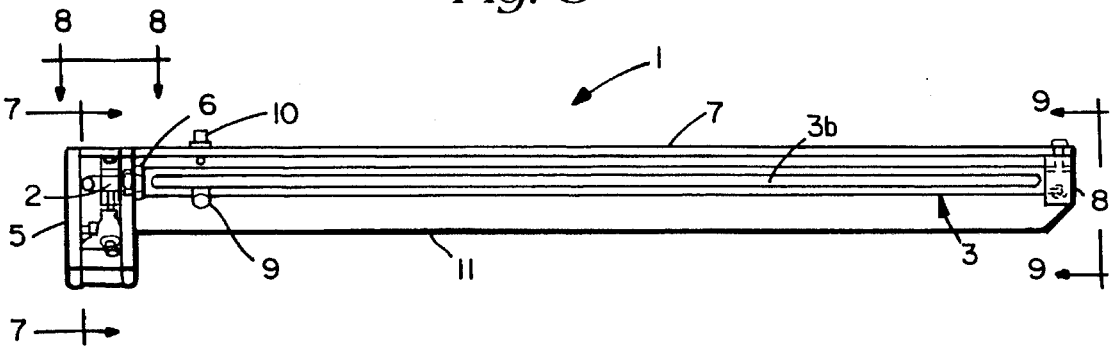
FIG. 5 is a top view of the manifold.

FIG. 5 is a top view of the manifold (1) including the manifold drive (2), the manifold assembly (3), the drive housing (5), the bushing (6), the stop block (9), the screw (10) on the first mounting angle (7), the end block (8) and the second mounting angle bracket (11), which is connected with one end to the drive housing (5) and with the other end to the end block (8) of the manifold assembly (3).

Figure 6:
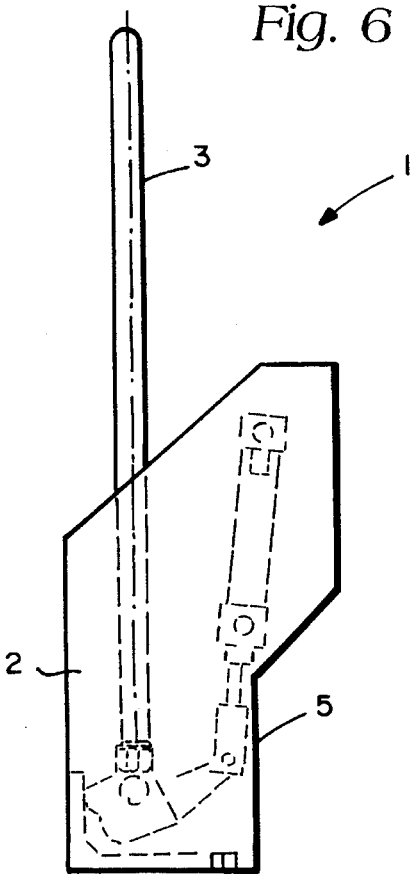
FIG. 6 is a side view of the manifold, showing the interior parts in dotted lines.

FIG. 6 is a side view of the manifold (1) with the drive housing (5) and the manifold assembly (3).

Figure 7:
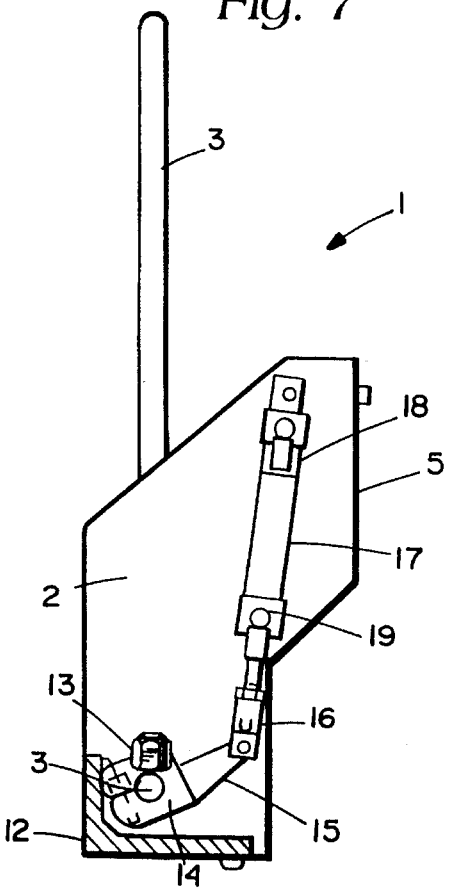
FIG. 7 is a cross-sectional view of a detail of the manifold along the section 7—7, shown in FIG. 5.

FIG. 7 is a cross-sectional view of the drive housing (5) of the manifold (1) taken along the section 7—7, shown in FIG. 5, including the manifold assembly (3).

The third mounting angle bracket (12) is a part of the drive housing (5). In the drive housing (5) is the connector (13) which is connected to the manifold assembly (3) and an air source which is not shown in FIG. 7. The manifold assembly (3) is rotatably connected over jam (14), arm (15) and rod (16) to the air cylinder (17), which has an upper arm (18) and a lower arm (19), both arms being connected to an air source, which is not shown in FIG. 7.

Figure 8:
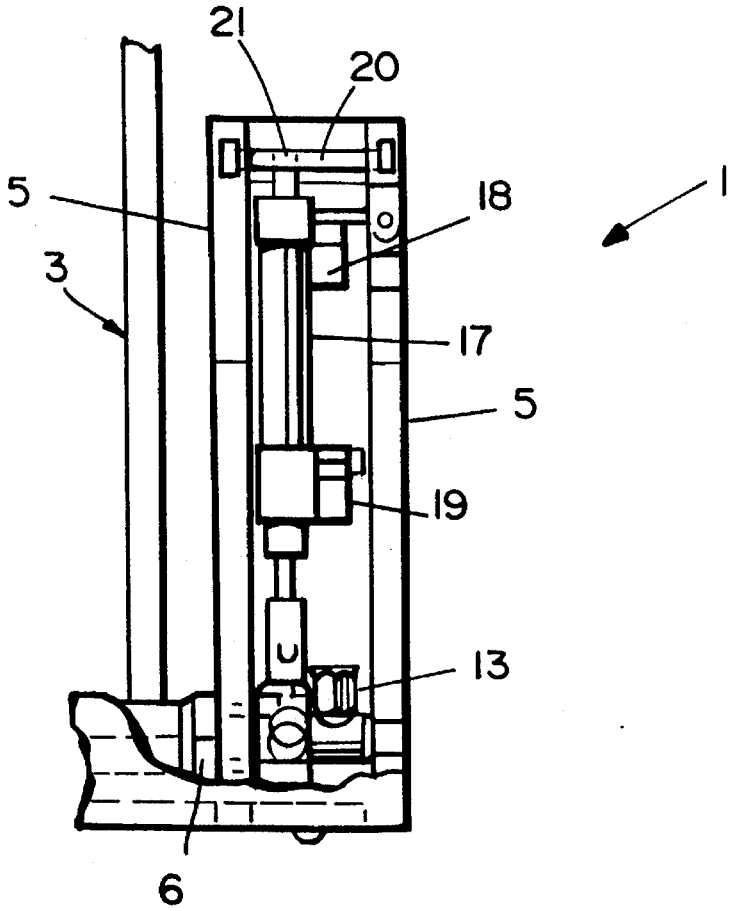
FIG. 8 is a cross-sectional view of a detail of the manifold along the section 8—8, shown in FIG. 5.

FIG. 8 is a cross sectional view of the drive housing (5) along the section 8—8 and shows pin (20) which is connected to the drive housing (5) and which has a bore (21) for holding the air cylinder (17) in place.

Figure 9:
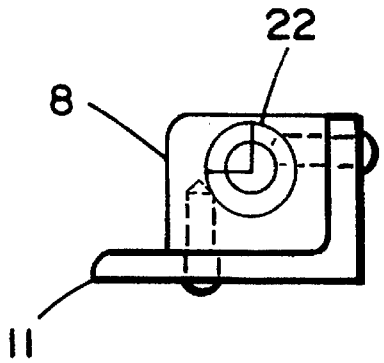
FIG. 9 is a side view of a detail of the manifold along the section 9—9 shown in FIG. 5.

FIG. 9 is a cross sectional view of the end block (8) along the section 9—9, shown in FIG. 5 and shows the bushing (22) of the manifold assembly (3) in the end block (8) and the end of the mounting angle bracket (11).

Figure 10A:
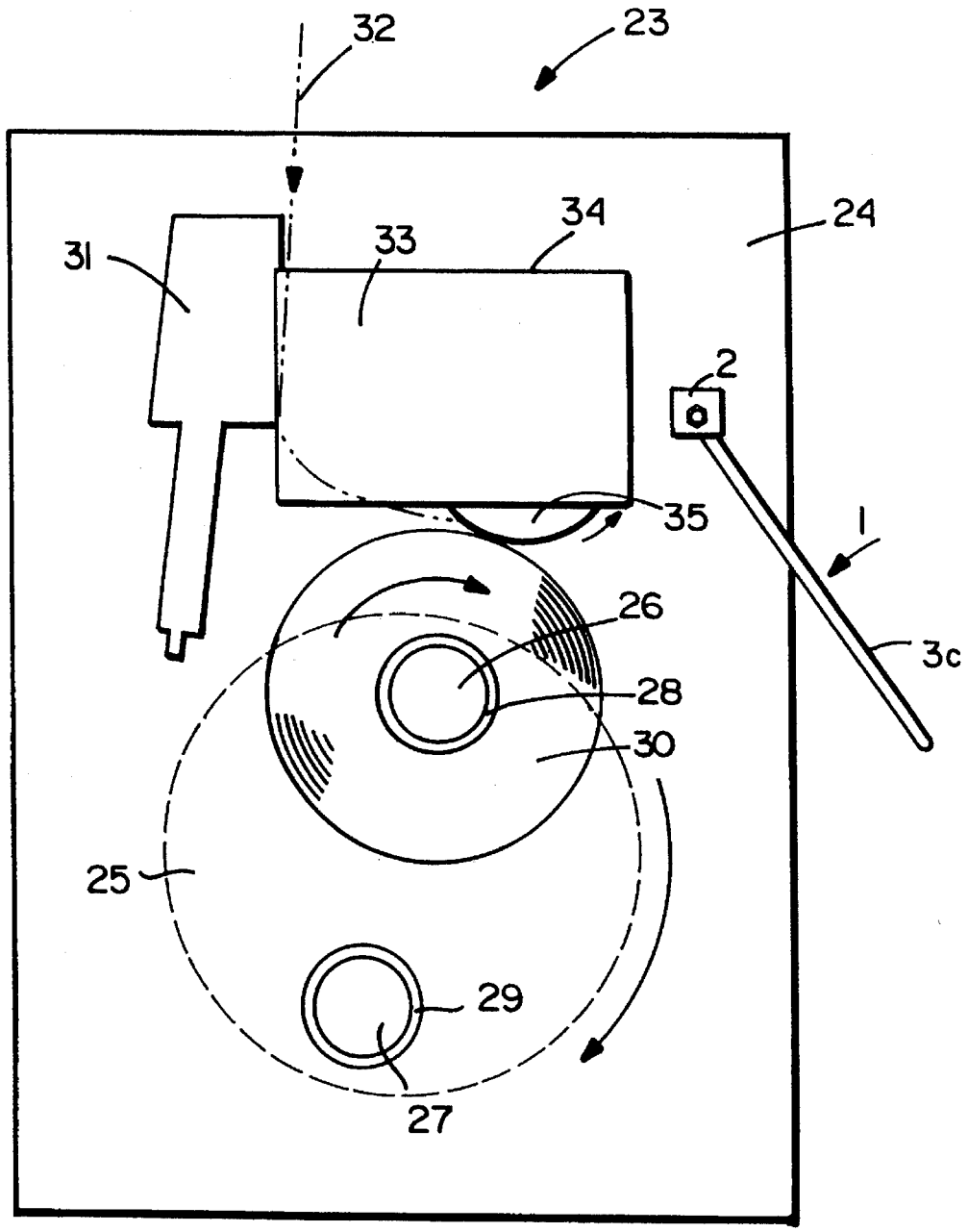
FIG. 10*a* is a front view of the yarn winding apparatus with a fully wound package and at the beginning of the doffing. The manifold is in the stand-by position.
Figure 10B:
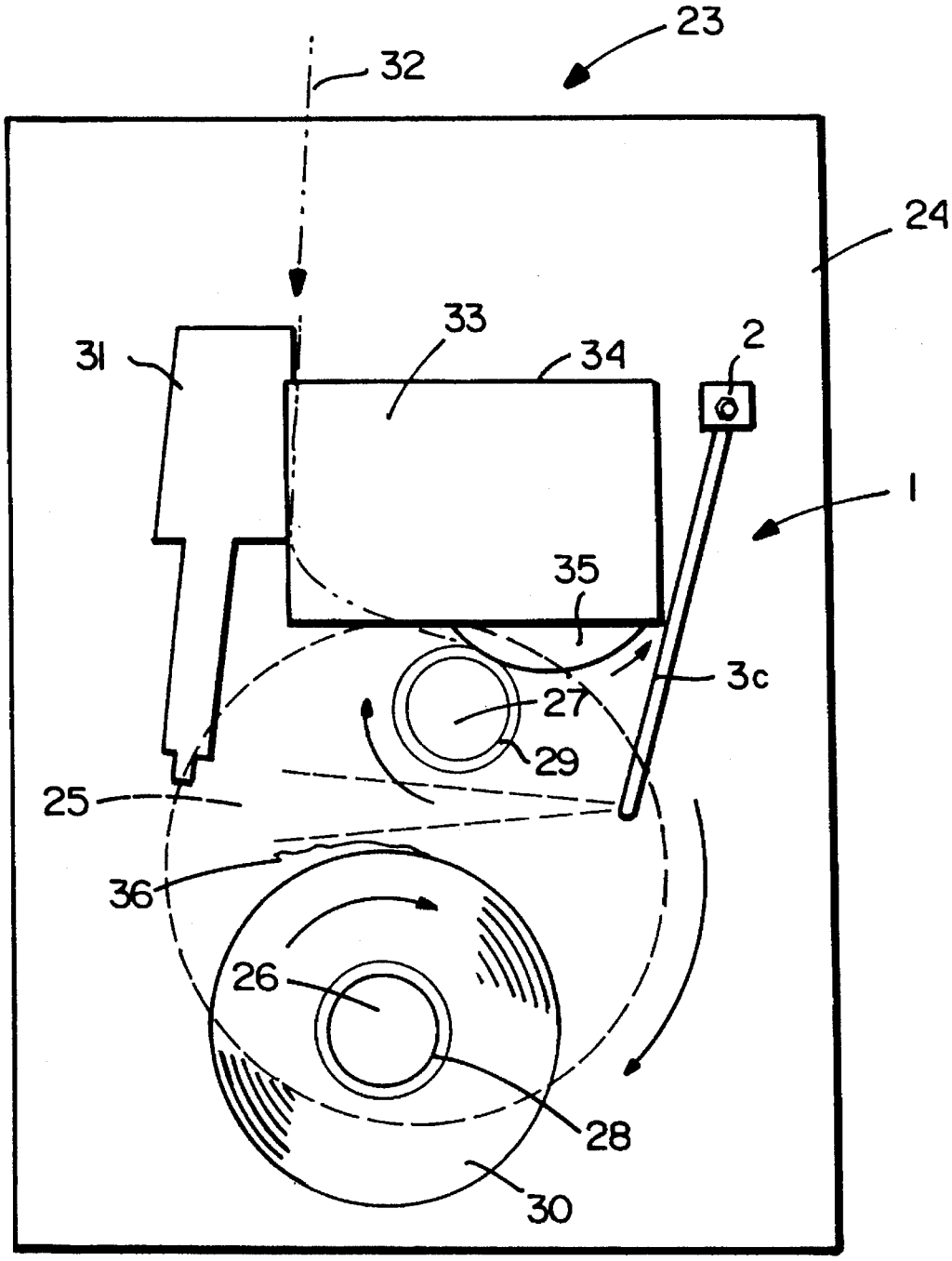
FIG. 10*b* is a front view of the yarn winding apparatus of FIG. 10*a* after the doffing. The manifold is in the blowing position.
Figure 10C:
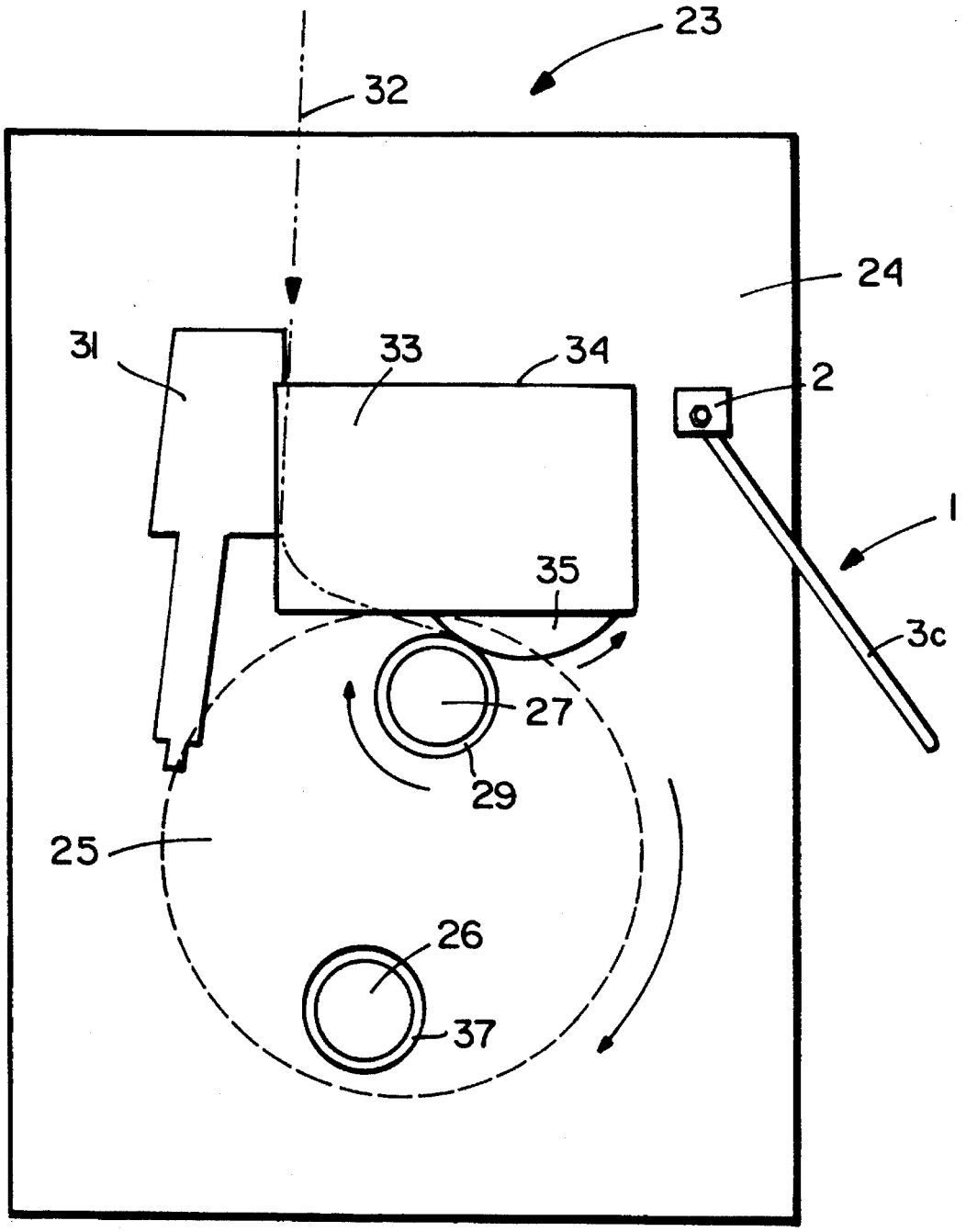
FIG. 10*c* is a front view of the yarn winding apparatus of FIG. 10*a* after replacement of the fully wound package by an empty bobbin. The manifold is in the stand-by position.

FIGS. 10*a* to 10*c* show the manifold (1) in a yarn winding apparatus (23) in three different stages of the yarn winding process.

FIG. 10*a* is a front view of the yarn winding apparatus (23) which has a frame (24) with the manifold (1) in the stand-by position mounted thereon including the manifold assembly (3) and the drive (2). A turret disc (25) is rotatably mounted on the frame (24). Two spindles (26) and (27) are rotatably mounted on the turret disc (25) for holding bobbins (28) and (29) on which the yarn is wound. Bobbin (28) carries a fully wound yarn package (30). The turret disc (25) is driven by a motor which is located behind the turret disc (25), which is not shown in FIG. 10*a*. A transfer mechanism (31) which transfers the incoming fiber (32) to the empty bobbin (29) to start a new yarn package is movably connected to the frame (24).

The transfer mechanism may include transfer arms, yarn guides, and means for transferring signals for doffing or moving the manifold (1), like optical, pneumatical or electrical contacts, switches and electrical connections.

A winder head (33) with housing (34) and drive roll (35) is connected to the frame (24) and drives the yarn package (30) and at the same time the spindle (26) and the bobbin (28).

FIG. 10*b* is a front view of the yarn winding apparatus (23), shown in FIG. 10*a* after doffing with the following differences:

The fully wound package (30), together with bobbin (28) and spindle (26) is in a lower position, while the loose yarn end (36) is being wound around the package (30). Spindle (27) including bobbin (29) is in an upper position when new yarn is being wound thereon. The manifold (1) is in the operative or blowing position, such that an air curtain is blown between the rotating full package (30) and the new rotating bobbin (29), shown as dotted lines in FIG. 10*b*, thereby keeping the loose yarn end (36) of yarn package (30) down and away from entangling with new winding bobbin (29).

FIG. 10*c* is a front view of the yarn winding apparatus (23) shown in FIG. 10*b* with the following differences: The fully wound yarn package (30) shown in FIG. 10*b* has been replaced by a new bobbin (37) and the manifold (1) has again been pivoted into the stand-by position, whereby no air is blown.

The operation of the manifold (1) of the present invention is described with reference to FIGS. 2 to 9.

FIGS. 3 to 9 show the manifold assembly (3) in a neutral position, in which no air is flowing through either the manifold assembly (3) and the jets (4) nor through the air cylinder (17). This is the case when the air supply is interrupted.

In FIG. 2 the manifold assembly (3) is in the stand-by position, which means no air is flowing through the manifold assembly (3) and the jets (4) but air is flowing through the air cylinder (17). To move the manifold assembly (3) from the stand-by position into the blowing position, indicated with the dotted lines in FIG. 2, air from an air source, which is not shown in the Fig.'s is introduced in the lower arm (19) of the air cylinder (17), thereby moving a piston inside the air cylinder (17) upwards (not shown in FIG. 7). The upward movement of the piston moves the rod (16) upwards, which turns jam (14) over arm (15), thereby pivoting the manifold assembly (3) until stop (9) is stopped by screw (10), shown in FIGS. 3 and 5. This position is the blowing position, whereby air is directed through the connector (13) into the manifold assembly (3) and through the jets (4) thereby forming an air curtain.

To move the manifold assembly (3) from the blowing position and into the stand-by position, air is introduced into the upper arm (18) of the air cylinder (17), thereby moving the piston inside the air cylinder (17) downwards. This in turn forces rod (16) downwards, thereby turning jam (14) over arm (15), which pivots the manifold (3) into the stand-by position. The flow of air into the connector (13) is stopped in this position. The angle α between the stand-by position and the blowing position, shown in FIG. 2 may vary from about 25° to about 270°, preferably from about 30° to about 180°, most preferred from about 45° to about 90°.

The jets (4) in the manifold assembly (3) may have different kinds of shapes like round, oval, rectangular and square, preferred are round jets.

The manifold assembly (3) has from 1.0 to about 100 jets, preferably from about 20 to about 50 jets with a diameter of from about 0.01 to about 0.1 inches, preferably from 0.02 to about 0.05 inches. A suitable air source for the drive (2) as well as for the formation of the air curtain in the blowing position is an air compressor which delivers air of a pressure of from about 1 to about 200 psi, preferably from about 50 to about 100 psi.

The operation of the yarn winding apparatus (23) of the present invention is described with reference to FIGS. 10 *a–c:*

In FIG. 10*a* the yarn (32) is wound on the bobbin (28) which is carried by the spindle (26). The bobbin (28) and the winding package (30) are rotated by the driving roll (35) of the winder head (33). The winding speed is from about 2000 to about 5000 m/min, preferably from about 2500 to about 4000 m/min.

When the package (30) is fully wound, doffing starts with a clockwise rotation of the turret disc (25), which is driven by a drive like a motor, which is not shown in FIG. 10*a*. The doffing is finished when the fully wound package (30) is in the lower position indicated in FIG. 10*b* and the bobbin (29) on the spindle (27) is in the upper position. At this time the manifold assembly (3) pivots from the stand-by position, indicated in FIG. 10*a* to the blowing position, shown in FIG. 10*b*. In this position, compressed air is blown through the jets (4) to form an air curtain between the fully wound package (30) and the bobbin (29). The yarn is cut by fixed knives on a spindle and a new package is wound on bobbin (29). The loose yarn end (36) of the fully wound package (30) is blown down by the air curtain formed by the jets of the manifold assembly (3), thereby keeping it from being entangled in the winding package on bobbin (29) or other parts of the winding apparatus (23). After the fully wound package (30) has been removed, a new bobbin (37) is placed on spindle (26), whereby the manifold assembly (3) swings back into the stand-by position, indicated in FIG. 10*c*. The radius of the new package as it is being wound on bobbin (29). The winder head (33) and the driving roll (35) are thus moved upwardly (if the winder head (33) is movably mounted to the frame (24)) or the turret disc (25) is displaced in order to accommodate the growing radius of the new package (if the winder head (33) is fixedly mounted to the frame (24)). When the yarn package is fully wound, doffing occurs and a new cycle starts.

Advantages of the yarn winding apparatus including the manifold of the present invention are a reduction of loose yarn ends being entrapped in running yarn packages and a reduction in yarn waste being caught in running yarn packages which resulted in a reduction of off quality yarn packages of from about 2% to less than 0.5% over a production period of 6 months.

We claim:

1. A yarn winding apparatus comprising:

a turret which carries at least one pair of parallel spindles for holding bobbins on which yarn is wound, said turret being rotatable so as to present one of the spindles to a yarn-winding position wherein yarn is wound about the bobbin thereon to form a yarn package, and the other of the spindles to a doffing position wherein a full yarn package with a free yarn end wound around the bobbin may be removed from the spindle; and a manifold assembly for directing a stream of air between said pair of spindles to prevent entanglement of the free yarn end wound around the bobbin carried by the other of the spindles when in said doffing position from becoming entangled with the yarn being would about the bobbin carried by the one spindle when in said yarn-winding position, said manifold assembly including;

(a) an elongate tubular manifold element positioned parallel to said pair of spindles and having at least one jet which directs a curtain of air between said pair of spindles when said one spindle is in said yarn-winding position and said other spindle is in said doffing position;

(b) a manifold drive for swinging said elongate tubular manifold between blowing and stand-by positions wherein said elongate tubular member is disposed closer and farther from said spindles, respectively, wherein said at least one jet directs the curtain of air between said spindles when said elongate tubular manifold element is in said blowing position; and (c) a tubular riser having one end fluid-connected to said tubular manifold and an opposite end operatively connected to said manifold drive, wherein said manifold drive pivots said tubular riser which in turn swings said elongate tubular manifold between said blowing and stand-by positions.

2. The yarn winding apparatus of claim 1, wherein said manifold drive includes an air cylinder having an actuator rod, and an actuator arm operatively interconnecting said actuator rod and said elongate tubular manifold element, wherein upwards and downwards movement of said actuator rod in response to actuation of said air cylinder responsively causes said actuator arm to effect swinging movement of said tubular manifold element between said stand-by and said blowing positions, respectively.

3. The yarn winding apparatus of claim 1, wherein said tubular manifold element swings between said blowing and stand-by positions through an angle α which is between 25° to about 270°.

4. The yarn winding apparatus of claim 1, wherein manifold assembly includes a stop assembly which establishes said blowing position of said elongate tubular manifold element.

5. The yarn winding apparatus of claim 1, wherein said manifold assembly includes a mounting assembly for mounting said manifold assembly such that said elongate tubular manifold element extends parallel to said pair of spindles.

6. The yarn winding apparatus of claim 5, wherein said mounting assembly includes an elongate mounting bracket having one end connected to said manifold drive and having an opposite end which carries an end block.

7. The yarn winding apparatus of claim 6, having an elongate base tubular element extending between said manifold drive and said end block, a pair of longitudinally separated tubular riser elements fluid-connected to said base tubular element at one end thereof and to said elongate tubular manifold element at the other end thereof.

8. The yarn winding apparatus of claim 6, having an elongate base tubular element operatively connected to said manifold drive and extending parallel to said elongate tubular manifold element, and a pair of longitudinally separated tubular risers each fluid-connected at one end to said base tubular element and at the other end to said elongate tubular manifold element for radially separating said elongate tubular manifold element from said base tubular element.

9. The yarn winding apparatus of claim 1 or 8, wherein said elongate tubular manifold element includes a plurality of said jets.

10. The yarn winding apparatus of claim 9, wherein said elongate tubular manifold element includes between 10 to 100 said jets.

11. The yarn winding apparatus of claim 10, wherein said jets each have a diameter of between 0.01 to 0.10 inch.

* * * * *